US008678762B1

(12) United States Patent
Baker

(10) Patent No.: US 8,678,762 B1
(45) Date of Patent: Mar. 25, 2014

(54) CONICAL AIR FLOW SYSTEM

(75) Inventor: Michael J. Baker, Broken Arrow, OK (US)

(73) Assignee: M.A.D. Capital LLC

( * ) Notice: Subject to any disclaimer, the term of this patent is extended or adjusted under 35 U.S.C. 154(b) by 745 days.

(21) Appl. No.: 12/802,934

(22) Filed: Jun. 17, 2010

(51) Int. Cl.
*F03B 3/00* (2006.01)
*F03D 11/00* (2006.01)
*F04D 29/00* (2006.01)

(52) U.S. Cl.
USPC ..... 415/219.1; 415/222

(58) Field of Classification Search
USPC ..... 415/147, 219.1, 22, 222, 108, 220; 416/247 R
See application file for complete search history.

(56) References Cited

U.S. PATENT DOCUMENTS

| | | | | | |
|---|---|---|---|---|---|
| 3,421,544 | A * | 1/1969 | Bozoyan | 137/505.47 |
| 4,064,203 | A * | 12/1977 | Cox | 261/99 |
| 4,149,689 | A * | 4/1979 | McDonald | 244/53 B |
| 4,936,803 | A * | 6/1990 | Burge | 440/66 |
| 5,020,270 | A * | 6/1991 | Lo | 43/112 |
| 6,616,404 | B1 * | 9/2003 | Davis et al. | 415/147 |
| 6,629,424 | B1 * | 10/2003 | Araki et al. | 62/244 |
| 7,470,178 | B2 * | 12/2008 | Tajiri | 454/155 |
| 7,753,644 | B2 * | 7/2010 | Krippene | 415/4.2 |
| 8,052,083 | B1 * | 11/2011 | Moran | 244/53 B |

* cited by examiner

*Primary Examiner* — Edward Look
*Assistant Examiner* — Christopher J Hargitt
(74) *Attorney, Agent, or Firm* — Gable Gotwals

(57) ABSTRACT

A cone-shaped air flow system has improved efficiency, increased plenum chamber exit air flow speeds and reduced noise levels in comparison to box-shaped and triangular air flow systems. The heater may be of half or full cone configuration for perimeter or central plenum locations, respectively.

9 Claims, 3 Drawing Sheets

CONICAL AIR FLOW SYSTEM

BACKGROUND OF THE INVENTION

This invention relates generally to air handling equipment and more particularly concerns heat exchange systems.

Known heat exchange systems are generally box-shaped and perform with efficiencies that can be quantitatively or experientially determined. Recently, a triangular air flow system was developed which orients heating coils in double or compound angles in relation to its fan in order to increase heating efficiency. The triangular air flow system in theory increases the velocity of air flowing directly through its heating coils and reduces bounce-back air turbulence, noise and static pressure on its fan. Based on tests of the triangular air flow system, its plenum chamber exit air flow speeds are in the order of 700 fpm and its noise levels are in the order of 64-67 db, compared to speed and noise level ranges of 700 to 900 fpm and 64-67 db for a variety of box-shaped air flow systems.

It is, therefore, an object of the present invention to provide an air flow system having improved efficiency in comparison to box-shaped and triangular air flow systems. Another object of the present invention is to provide an air flow system having increased plenum chamber exit air flow speeds in comparison to box-shaped and triangular air flow systems. A further object of the present invention is to provide an air flow system having reduced noise levels in comparison to box-shaped and triangular air flow systems.

SUMMARY OF THE INVENTION

In accordance with the invention, a conical air flow system is provided which affords improved efficiency, increased plenum chamber exit air flow speeds and reduced noise levels in comparison to box-shaped and triangular air flow systems.

In a first embodiment, the conical air flow system has a housing in the shape of a diametrically divided or half-cone. An air inlet port into the housing is defined by the semi-circular base of the cone. At least one air exit port is located in the side wall of the cone. A fan induces vortical air flow through the inlet port into the housing. Preferably, the housing has two air exit ports symmetrically spaced in the side wall of the half-cone. The base angle of the half-cone is in a range of 40-80°.

In a second embodiment, the conical air flow system has a housing in the shape of a full cone. An air inlet port into the housing is defined by the circular base of the cone. At least one air exit port is located in the side wall of the cone. A fan induces vortical air flow through the inlet port into the housing. Preferably, the housing has three air exit ports in the side wall of the housing symmetrically spaced in a 360° array. The cone has a base angle in a range of 40-80°.

In either embodiment, the total area of the air exit ports is at least as great as the area of the air inlet port or the rotational area covered by the fan blades, whichever is smaller. The contours and angles result in an air flow system which has plenum chamber exit air flow speeds in a range of 1000-1350 fpm, or 30 to almost 100% higher speeds than the triangular heater, and which operates at noise levels in a range of 55-58 db, which is approximately 5 db lower than the triangular heater.

BRIEF DESCRIPTION OF THE DRAWINGS

Other objects and advantages of the invention will become apparent upon reading the following detailed description and upon reference to the drawings in which.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Figure 1:
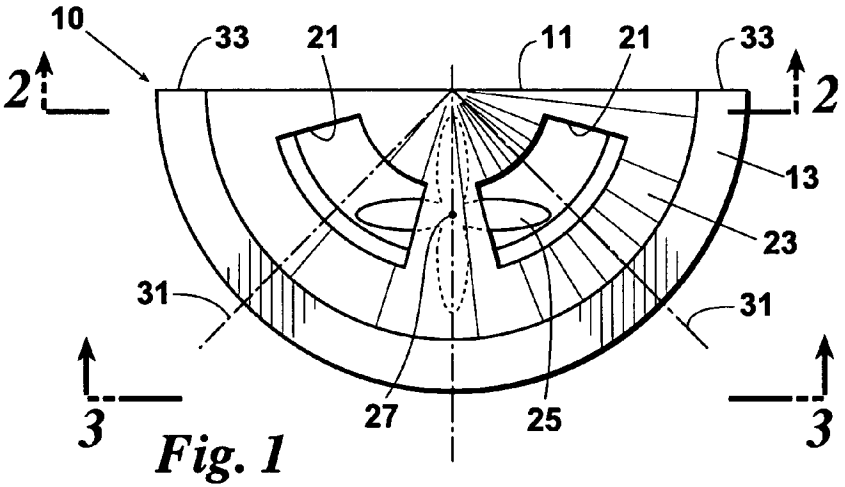
FIG. 1 is a top plan view of a half-cone embodiment of a conical air flow system.
Figure 2:
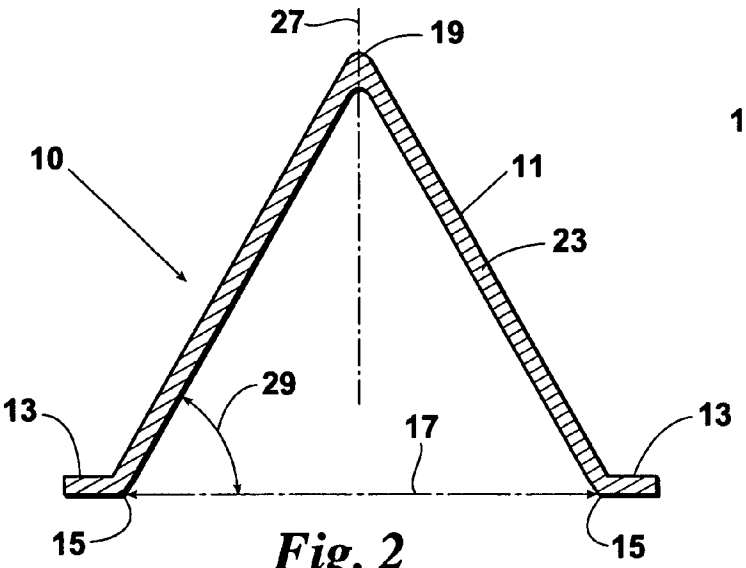
FIG. 2 is a cross-sectional view taken along the line 2-2 of FIG. 1.
Figure 3:
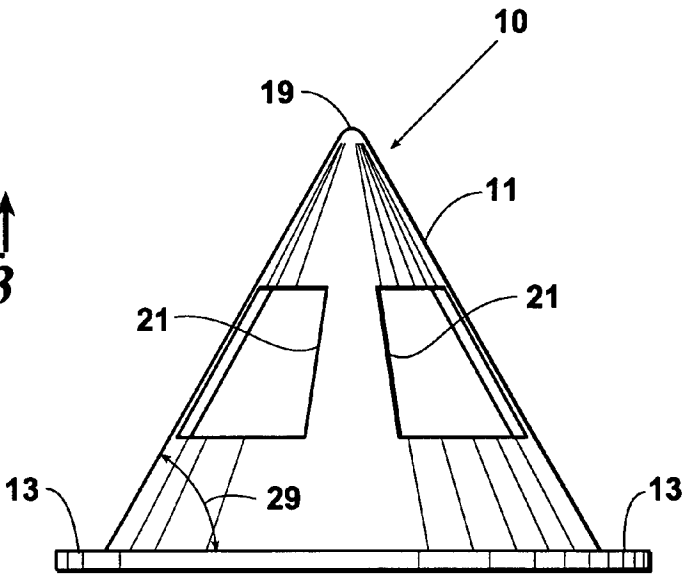
FIG. 3 is side elevation view of the half-cone embodiment of FIG. 1.

Turning first to FIGS. 1-3, a first half-cone embodiment of the air flow system is illustrated. A housing 10 has the shape of a diametrically divided cone 11 with an outwardly extending radial mounting flange 13 along its base edge 15. As shown, the base edge 15 defines an air inlet port 17 into the housing 10. However, the air inlet port 17 could be made smaller and shaped differently than the semi-circular base edge 15 of the divided cone 11 by extending the flange 13 inwardly to the desired perimeter of the air inlet port 17. As best seen in FIGS. 2 and 3, the apex 19 of the divided cone 11 is slightly blunted. As shown, two air exit ports 21 extend through the side wall 23 of the housing 10. A fan 25 is positioned below the plane of the base edge 15 for rotation about a vertical axis 27 through the center of the air inlet port 17 of the half-cone 11 to induce vortical air flow in the housing 10. The cone 11 has a base angle 29 in a range of 40-80° and, as shown, 60°. Preferably, the air exit ports 21 are symmetrically spaced in the side wall 23 of the cone 11 with the center lines 31 of the ports 21 spaced at 90-120°. As shown, the center lines 31 are spaced 45° from the diametric edges 33 of the housing 10 and the ports 21 span 60° across their centerlines 31. However, the air exit ports 21 can be of any shape and in any location in the side wall 23 as long as their total area is at least as great as the area of the air inlet port 17 or the rotational area covered by the blades of the fan 25, whichever is smaller.

The housing flange 13 is mounted on the fan housing (not shown) with the diametric edges 33 butted against a surface of the cabinet (not shown) in which the air flow system is to be contained. The cabinet surface completes the half-conical housing 10. As vertical flow is induced in the housing 10 by the fan 25, the conical housing 10 pressurizes the induced vertical air flow, thereby removing any air pockets produced by the fan 25. As the air stream exits the housing 10 through the exit ports 21, the treated air is carried farther, thus improving airflow capabilities and velocities. The shape of the half-cone 11 allows the housing 10 to be installed in a variety of orientations with increased stability. The conical system also reduces material costs compared to the known triangle and conventional body systems.

Figure 4:
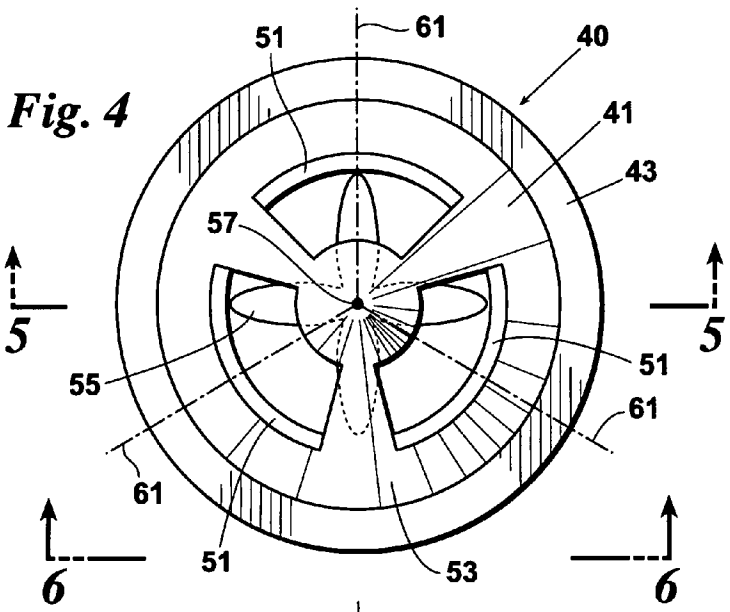
FIG. 4 is a top plan view of a full-cone embodiment of a conical air flow system.
Figure 5:
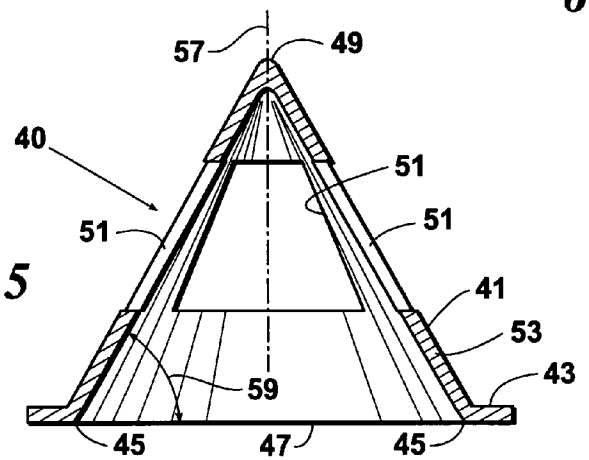
FIG. 5 is a cross-sectional view taken along the line 5-5 of FIG. 4.
Figure 6:
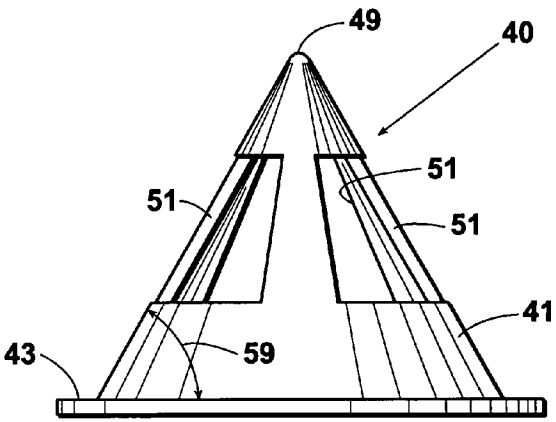
FIG. 6 is side elevation view of the full-cone embodiment of FIG. 4.

Turning now to FIGS. 4-6, a full-cone embodiment of the air flow system is illustrated. A housing 40 has the shape of a cone 41 with an outwardly extending radial mounting flange 43 along its base edge 45. As shown, the base edge 45 defines a circular air inlet port 47 into the housing 40. However, the air inlet port 47 could be made smaller and shaped differently than the circular base edge 45 of the cone 41 by extending the flange 43 inwardly to the desired perimeter of the air inlet port 47. As best seen in FIGS. 5 and 6, the apex 49 of the cone 41 is slightly blunted. As shown, three air exit ports 51 extend through the side wall 53 of the housing 40. A fan 55 is positioned below the plane of the base edge 45 for rotation about the vertical axis 57 of the cone 41 to induce vortical air flow in the housing 40. The cone 41 has a base angle 59 in a range of 40-80° and, as shown, 60°. Preferably, the air exit ports 51 are symmetrically spaced in the side wall 53 of the cone 41 with the center lines 61 of the ports 51 spaced at 120° intervals. However, the air exit ports 51 can be of any shape and in any location in the side wall 53 as long as their total area is at least as great as the area of the air inlet port 47 or the rotational area covered by the blades of the fan 55, whichever is smaller.

The housing flange 43 is mounted on the fan housing (not shown) in a cabinet (not shown) in which the air flow system is to be contained. As vortical flow is induced in the housing 40 by the fan 55, the conical housing 40 pressurizes the induced vortical air flow, thereby removing any air pockets produced by the fan 55. As the air stream exits the housing 40 through the exit ports 51, the treated air is carried farther, thus improving airflow capabilities and velocities. Installation is limited only to the base of the cone 41 but the full-cone housing 40 can be placed in horizontal or vertical orientation. The conical system also reduces material costs compared to the known triangle and conventional body systems. In the full-cone embodiment 40 as seen in FIGS. 4-6, if the height of the cone 41 is the same as the height of the cone 11 of the half-cone embodiment 10 seen in FIGS. 1-3, a larger volume of air is transferred.

Figure 9:
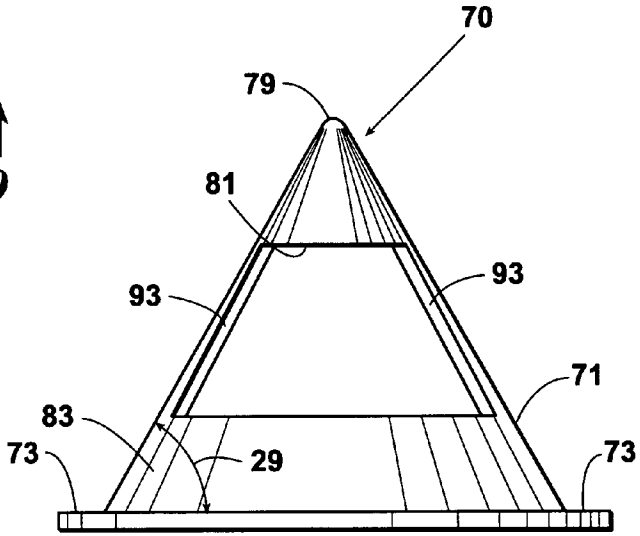
FIG. 9 is side elevation view of the half-cone embodiment of FIG. 7.
Figure 7:
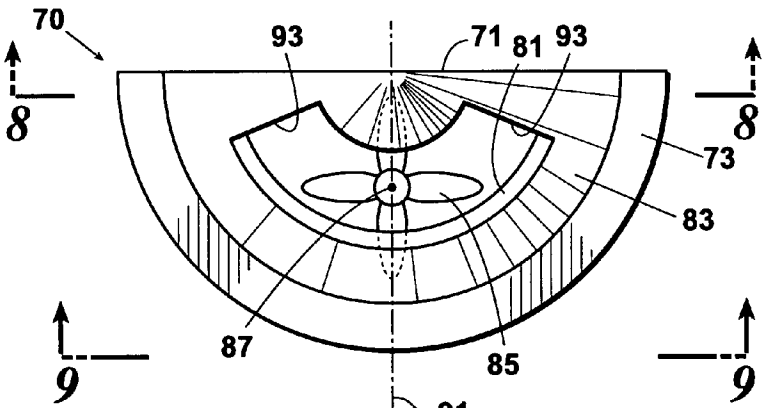
FIG. 7 is a top plan view of another half-cone embodiment of a conical air flow system.
Figure 8:
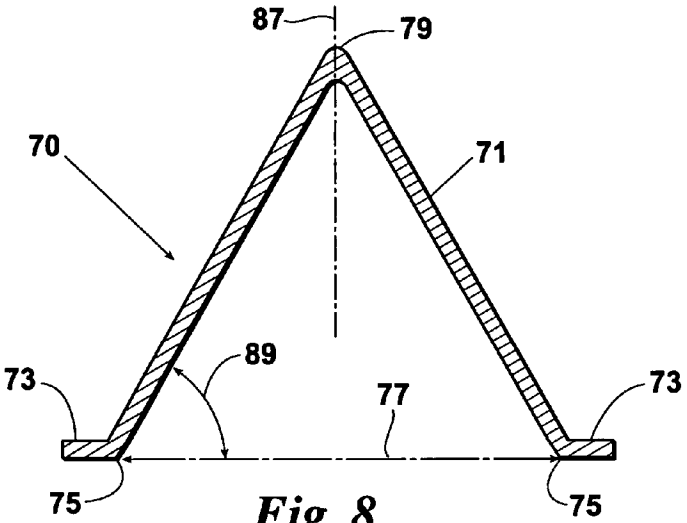
FIG. 8 is a cross-sectional view taken along the line 8-8 of FIG. 7.

Turning finally to FIGS. 7-9, another half-cone embodiment of the air flow system is illustrated. A housing 70 has the shape of a diametrically divided cone 71 with an outwardly extending radial mounting flange 73 along its base edge 75. As shown, the base edge 75 defines an air inlet port 77 into the housing 70. However, the air inlet port 77 could be made smaller and shaped differently than the semi-circular base edge 75 of the divided cone 71 by extending the flange 73 inwardly to the desired perimeter of the air inlet port 77. As best seen in FIGS. 8 and 9, the apex 79 of the divided cone 71 is slightly blunted. As shown, one air exit port 81 extends through the side wall 83 of the housing 70. A fan 85 is positioned below the plane of the base edge 75 for rotation about a vertical axis 87 through the center of the air inlet port 77 of the half-cone 71 to induce vortical air flow in the housing 70. The cone 71 has a base angle 89 in a range of 40-80° and, as shown, 60°. Preferably, the air exit port 81 is symmetrically spaced in the side wall 83 of the cone 71 with the center line 91 of the port 81 at the midpoint of the half-cone arc. As shown, the side edges 93 of the exit port 81 are approximately 135° apart. However, the air exit ports 81 can be of any shape and in any location in the side wall 83 as long as their total area is at least as great as the area of the air inlet port 77 or the rotational area covered by the blades of the fan 85, whichever is smaller.

The housing flange 73 is mounted on the fan housing (not shown) with the diametric edges 73 butted against a surface of the cabinet (not shown) in which the air flow system is to be contained. The cabinet surface completes the half-conical housing 70. As vortical flow is induced in the housing 70 by the fan 85, the conical housing 70 pressurizes the induced vortical air flow, thereby removing any air pockets produced by the fan 85. As the air stream exits the housing 70 through the exit port 81, the treated air is carried farther, thus improving airflow capabilities and velocities. The shape of the half-cone 71 allows the housing 70 to be installed in a variety of orientations with increased stability. The conical system also reduces material costs compared to the known triangle and conventional body systems.

In each of the above embodiments 10, 40 or 70 for many of their applications, the height of the cone 11, 41 or 71 will typically be approximately 14", but the height can vary greatly as long as the base angle 29, 59 or 89 is in the 40-80° range and optimally 60°. As shown, the air exit ports 21, 51 or 81 are substantially centered on the heights of the cones 11, 41 or 71 but need not necessarily be so centered. While conical systems will normally employ half (180°) or full (360°) cone housings, custom conical housings of anywhere from 90° to 360° can be formed as long as the total area of their exit ports is at least as great as the area of their air inlet port or the rotational area covered by the blades of their fan, whichever is smaller, and their base angle is in the 40°-80° range. Half-cone embodiments, such as the embodiments 11 and 71 shown in FIGS. 1-3 and 7-9, respectively, are best suited for use on the perimeter of the system cabinet. Full-cone embodiments, such as the embodiment 40 shown in FIGS. 4-6, are best suited for use in the center of the system cabinet. Custom angular embodiments are used in unique cabinet applications.

Thus, it is apparent that there has been provided, in accordance with the invention, a cone-shaped air flow system that fully satisfies the objects, aims and advantages set forth above. While the invention has been described in conjunction with specific embodiments thereof, it is evident that many alternatives, modifications and variations will be apparent to those skilled in the art and the light of foregoing description. Accordingly, it is intended to embrace all such alternatives, modifications and variations as fall within the spirit of the appended claims.

What is claimed is:

1. An air flow system comprising:

a housing having a half-cone shape and a base angle in a range of 40-80°;

an air inlet port through a base of said housing;

a fan inducing vortical air flow through said air inlet port into said housing; and at least one air exit port in a side wall of said housing, a total area of said air exit ports being at least as great as an area of said air inlet port and a rotational area covered by blades of said fan, whichever is smaller.

2. An air flow system according to claim 1 having two air exit ports in said side wall of said housing.

3. An air flow system according to claim 2, said air exit ports being symmetrically spaced in said side wall of said housing.

4. An air flow system according to claim 3, said air exit ports having center lines spaced by approximately 90°.

5. An air flow system comprising:

a housing having a full-cone shape and a base angle in a range of 40-80°;

an air inlet port through a base of said housing;

a fan inducing vortical air flow through said air inlet port into said housing; and at least one air exit port in a side wall of said housing, a total area of said air exit ports being at least as great as an area of said air inlet port and a rotational area covered by blades of said fan, whichever is smaller.

6. An air flow system according to claim 5 having three air exit ports in said side wall of said housing.

7. An air flow system according to claim 6, said air exit ports being symmetrically spaced at 120° intervals in said side wall of said housing.

8. An air flow system comprising:

a conical housing having a base angle in a range of 40-80°;

an air inlet port through a base of said housing;

a fan inducing vortical air flow through said air inlet port into said housing; and at least one air exit port in a side wall of said housing, a total area of said air exit ports being at least as great as an area of said air inlet port and a rotational area covered by blades of said fan, whichever is smaller.

9. An air flow system according to claim 8, said air exit ports being symmetrically spaced in said side wall of said housing.

* * * * *